US005720333A

United States Patent [19]

Turvey

[11] Patent Number: 5,720,333

[45] Date of Patent: Feb. 24, 1998

[54] LOCKING ASSEMBLY

[76] Inventor: Andrew Graham Turvey, 6 Collingrove Street, Eight Mile Plains, Queensland, 4113, Australia

[21] Appl. No.: 637,797

[22] PCT Filed: Nov. 4, 1994

[86] PCT No.: PCT/AU94/00679

§ 371 Date: May 3, 1996

§ 102(e) Date: May 3, 1996

[87] PCT Pub. No.: WO95/12739

PCT Pub. Date: May 11, 1995

[30] Foreign Application Priority Data

Nov. 4, 1993 [AU] Australia ..... PM2225

[51] Int. Cl.[6] ..... E06B 9/56

[52] U.S. Cl. ..... 160/290.1; 160/310; 292/DIG. 36

[58] Field of Search ..... 292/DIG. 36; 160/133, 160/201, 290.1, 188, 310

[56] References Cited

U.S. PATENT DOCUMENTS 3,751,088 8/1973 Schlage et al. .

4,237,711 12/1980 Kambic .

4,782,674 11/1988 Johnson ..... 292/DIG. 36

5,533,561 7/1996 Forehand, IV ..... 160/201 X

FOREIGN PATENT DOCUMENTS 346260 9/1919 Germany ..... 292/DIG. 36

*Primary Examiner*—Blair Johnson

*Attorney, Agent, or Firm*—Fitzpatrick, Cella, Harper & Scinto

[57] ABSTRACT

A motor driven roller shutter (10) employs a curtain (11) having a leading edge (12) and being adapted to slide vertical in a guide channel (14) between a raised position and a lowered position. A locking assembly (13) is secured to the channel (14) and is engageable with the shutter adjacent the leading edge (12) to inhibit the leading edge being levered away from the lowered position. The leading edge includes a flange (15) d the locking assembly includes a retractable foot (16) extending from a housing (17) so that in order to raise the shutter (11), the foot (16) must be retracted into the housing (17). A solenoid inner circuit is used to retract the foot (16) which then engages a limit switch to make the circuit to a motor to raise the curtain. Typically, the two locking assemblies are used opposite ends of the leading edge of the curtain.

7 Claims, 4 Drawing Sheets

LOCKING ASSEMBLY

FIELD OF THE INVENTION

THIS INVENTION relates to a locking assembly and in particular, but not limited to a locking assembly for a roller shutter or door.

BACKGROUND ART

Roller shutters of the type employing a curtain travelling in a pair of opposed guides are known. The curtain is arranged to move between an open rolled up position and a lowered closed rolled down position. These shutters are commonly used on industrial and commercial buildings, garages, shop fronts and windows.

These shutters are usually positioned so the curtain travels vertically, the curtain having a leading edge which moves up and down as the curtain travels so that the leading edge is in a lowermost position when the shutter is closed. These shutters can be arranged to operate under remote control using appropriate drive and control arrangements.

The shutters usually employ a lock to prevent access. Some locks are manually controlled while others are automatic or remote controlled. The current automatic locks used do not prevent an intruder from placing a bar under the leading edge of the shutter and using the bar as a lever to lift the shutter to gain access.

OUTLINE OF THE INVENTION

It is an object of the present invention to alleviate at least to some degree the aforementioned problems of the prior art.

With the above and other objects in mind, the present invention resides in one aspect in a roller shutter or door having a curtain including a leading edge moveable between a raised open position and a lowered closed position, a locking assembly having an electrically driven retractable blocking means engageable with the shutter to inhibit the leading edge being levered away from the lowered closed position, and control circuit means for operating the locking assembly.

The roller shutter can be any of the aforementioned types including those used as doors, on industrial and commercial buildings, garages, shop fronts, windows or the like.

In another aspect, the present invention resides in a locking assembly for a roller shutter including an electrically driven retractable blocking means moveable between a retracted position allowing movement of the shutter away from a lowered closed position and an extended position blocking movement of the shutter away from the lowered closed position and control circuit means for controlling operation of the locking assembly.

The blocking means typically comprises a retractable foot having a pivot located above an eccentrically mounted weight so that the foot normally hangs in the extended position thereby blocking movement of the shutter. Typically, a releasable shutter actuated catch is employed to hold the foot in the retracted position but releases the foot when the shutter is in the lowered closed position.

The locking assembly can be operated manually or automatically using any suitable drive means. The locking assembly is under electrical control employing a solenoid or equivalent to retract the foot when it is desirable to raise the shutter. The electrically driven means typically comprises a circuit and an actuator, the circuit including a solenoid or equivalent operable to retract the blocking means in response to the actuator initiating a shutter raising action. As a safety precaution, the locking assembly is preferably equipped with means enabling manual retraction of the blocking means.

Where the roller shutter is motor driven, the locking assembly preferably employs a motor override switch so that the motor does not operate unless the blocking means is retracted. The locking assembly typically includes means responsive to retraction of said blocking means to close the override switch and thereby enable the shutter to be raised.

The locking assembly is typically housed in a narrow housing securable in a fixed location adjacent the lowered closed position of the shutter and is typically coupled to channels in which the shutter travels. In another embodiment, the housing is secured directly to flooring or to an adjacent wall or to the flooring or wall via a suitable bracket. Typically, two locking assemblies are employed for each shutter with one locking assembly being employed on either side of the shutter and adjacent respective opposed channels in which the shutter travels.

BRIEF DESCRIPTION OF THE DRAWINGS

In order that the present invention can be more readily understood and be put into practical effect, reference will now be made to the accompanying drawings which illustrate one preferred embodiment of the present invention and wherein.

METHOD OF PERFORMANCE

Figure 1:
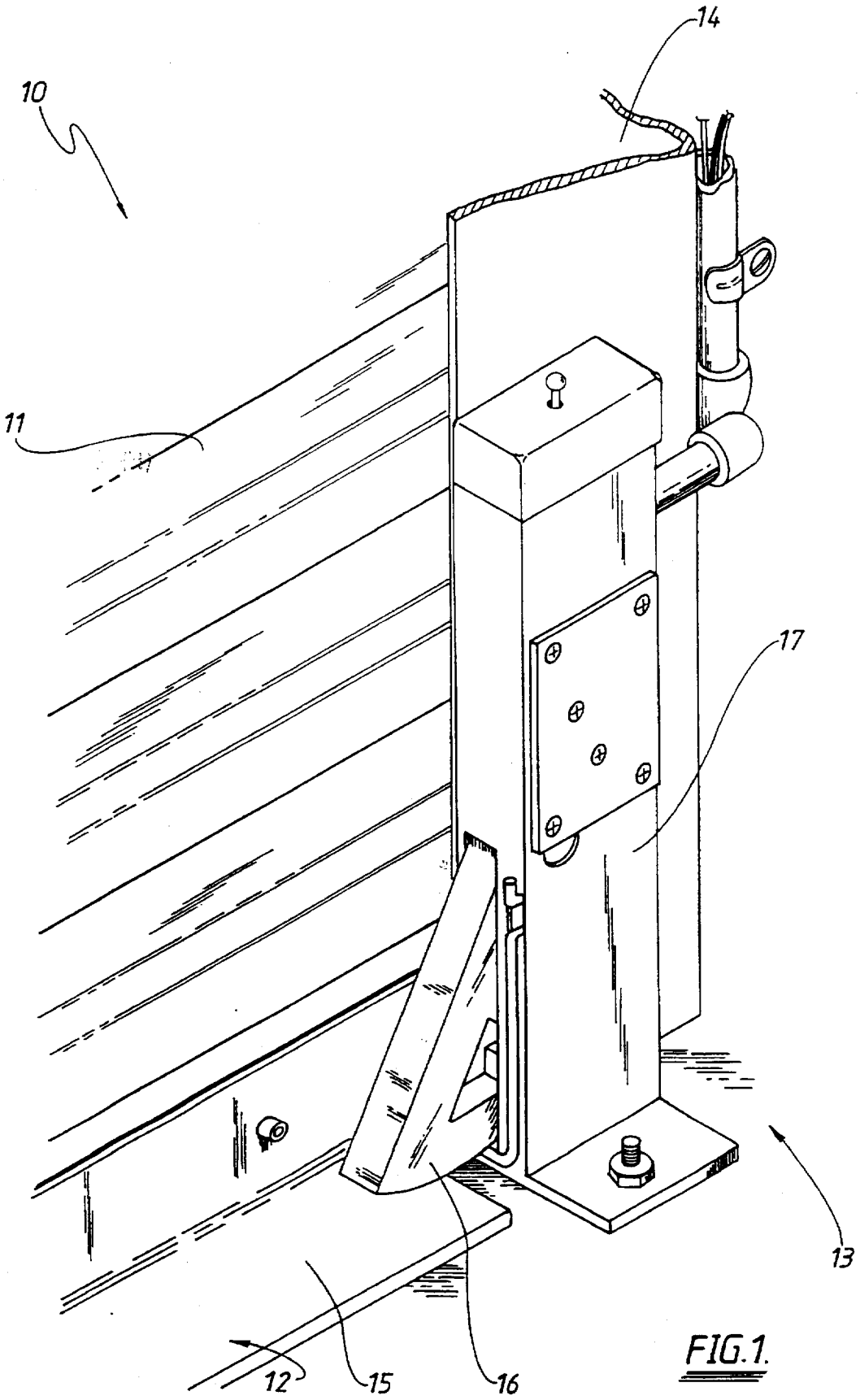
FIG. 1 is a part perspective view illustrating a shutter fitted out with a locking assembly according to one preferred embodiment of the present invention.

Referring to the drawings and initially to FIG. 1, there is illustrated a side portion of a roller shutter 10 employing a curtain 11 having a leading edge 12 and adapted to slide vertically in a guide channel 14 between a raised position and a lowered position as shown in FIG. 1. A locking assembly 13 is secured to the channel 14 and is engageable with the shutter 10 adjacent the leading edge 12 to inhibit the leading edge being levered away from the lowered position. In the illustrated embodiment, the leading edge includes a flange 15 and the locking assembly includes a retractable foot 16 extending from a housing 17 so that in order to raise the curtain 11, the foot 16 must be retracted into the housing 17.

It will be appreciated that the roller shutter 10 would normally employ a pair of channels 14 and therefore a pair of locking assemblies would also be employed one on each side.

The housing 17 is a narrow housing and is fastened to the channel 14 and includes means to retract the foot before the curtain 11 can be raised.

Figure 2:
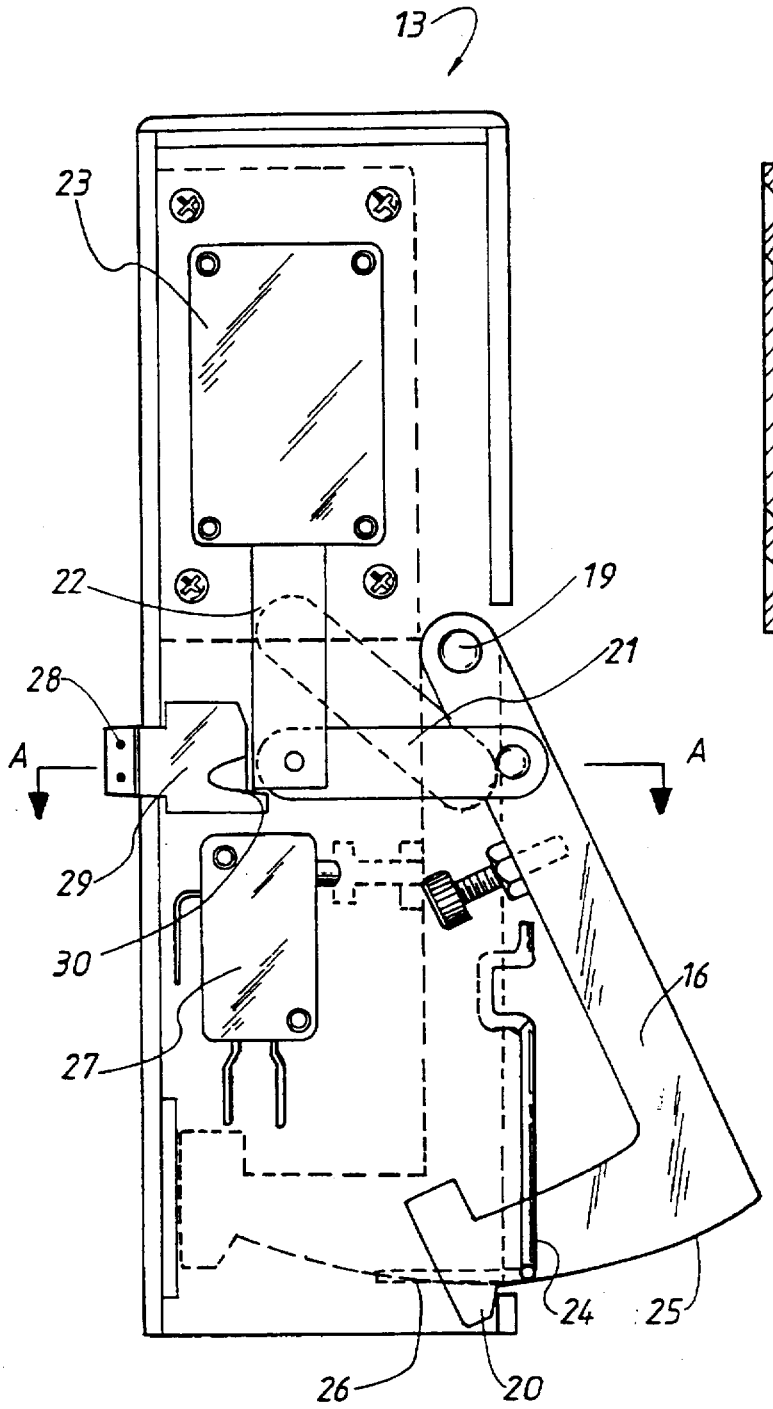
FIG. 2 is a side view of the locking assembly illustrated in FIG. 1 showing the internal operation of the locking assembly.
Figure 3:
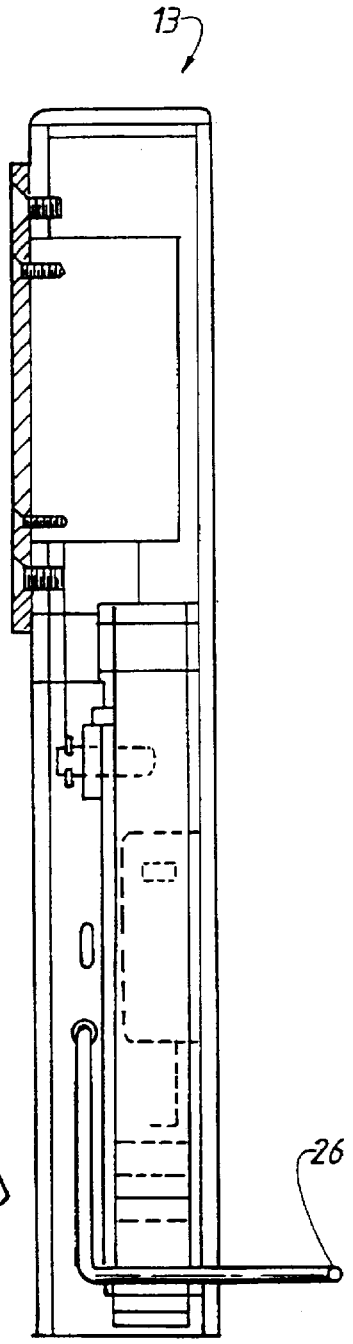
FIG. 3 is a edge on view of the assembly of FIG. 2.
Figure 4:
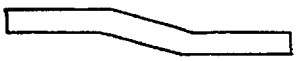
FIG. 4 is a section through A—A of FIG. 2.

Referring now to FIGS. 2 to 4, the locking assembly 13 will be illustrated in more detail.

In the illustrated embodiment, the locking assembly includes a foot 16 having a pivot 19, the foot 16 being L-shaped having an eccentrically positioned weight 20 so that the foot automatically moves to the extended position illustrated in FIG. 2 from the retracted position illustrated in phantom. The weight 20 is also enlarged providing a shoulder to prevent the foot from leaving the housing. A linkage 21 connected to a retractable rod 22 of a solenoid 23 is used to draw the foot 16 back into the retracted position where the weight 20 abuts against a rubber block which limits noise level and prevents jarring. A resilient catch 24 rides over an arcuate surface 25 of the foot 16 and then holds the foot 16 in the retracted position. The catch 24 includes a finger 26 which protrudes into the channel 14 so that the catch is engaged by the leading edge of curtain 11 as it moves to the lowered position. When curtain 11 is in the lowered position, the catch 24 releases the foot 16 and it automatically swings to the extended position illustrated in FIG. 2.

In order to prevent the shutter from being damaged, a limit switch 27 is employed. The limit switch 27 is wired in series with a drive motor used to lower and raise the curtain 11. As can be seen in FIG. 2, the foot 16 needs to be retracted in order to close the limit switch 27 for the motor to operate.

In addition, a manual override is provided employing a handle 28 which can be slid vertically to retract the rod 22 into the solenoid and thereby retract the foot into the housing. The handle 28 is coupled to a block 29 which also provides a support surface 30 to provide overall rigidity to the linkage 21 and prevent the rod 22 from being bent, should a person try to force entry by applying force to the foot 16.

Figure 5:
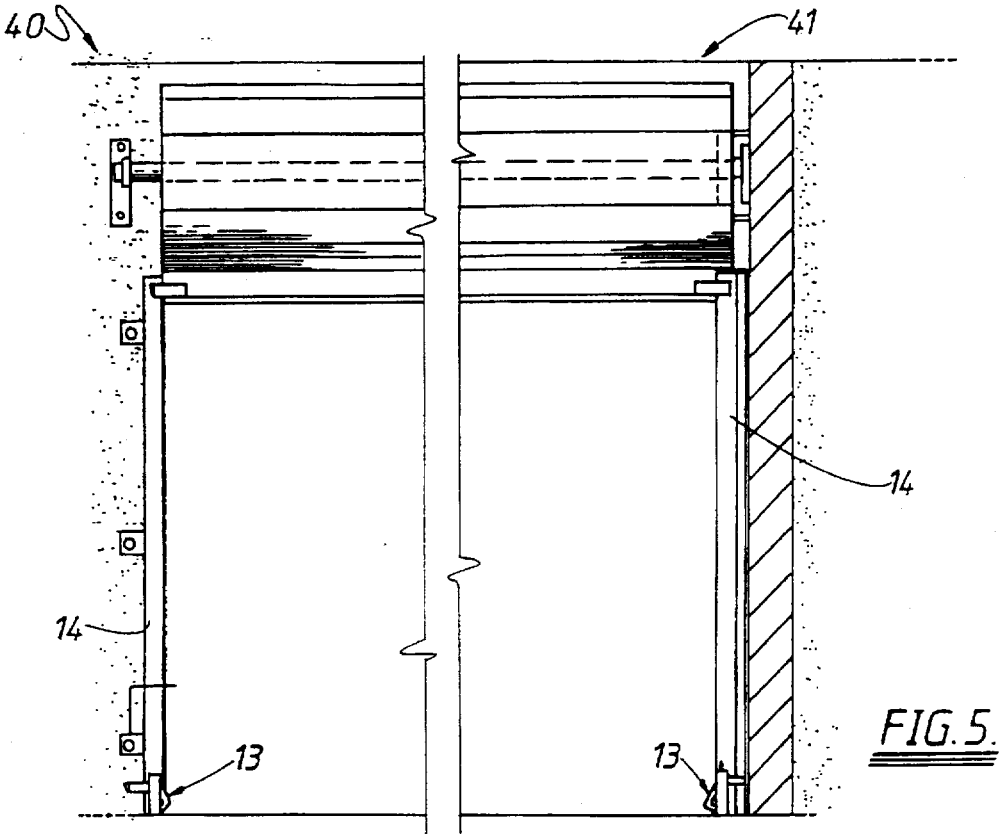
FIGS. 5 and 6 are side and end views of a typical dual locking assembly installation of the present invention.
Figure 6:
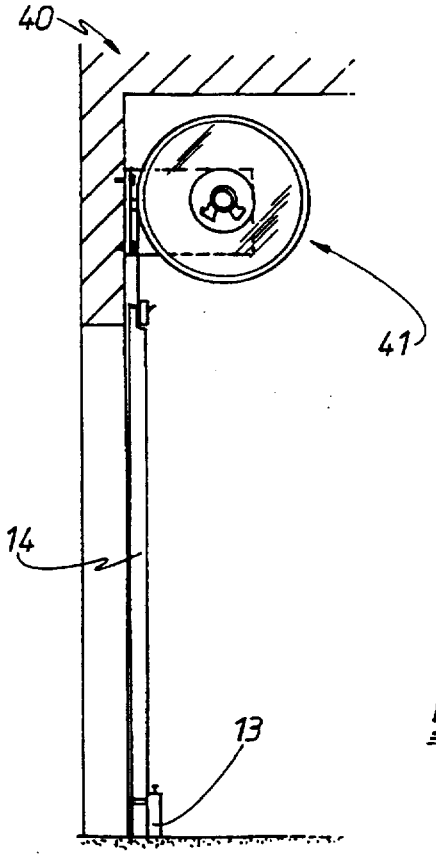

Referring now to FIGS. 5 and 6, there is illustrated application of the present invention to a motorised roller door 40 shown in FIGS. 5 and 6 in its installed position. A roller shutter drum and curtain assembly 41 is driven by a motor typically by a pulley and chain drive. The motor is not shown in FIGS. 5 and 6. The assembly 40 is equipped with guide channels 14 as previously described and in this case, dual locking assemblies 13 are employed and fitted as shown in FIG. 1.

Figure 7:
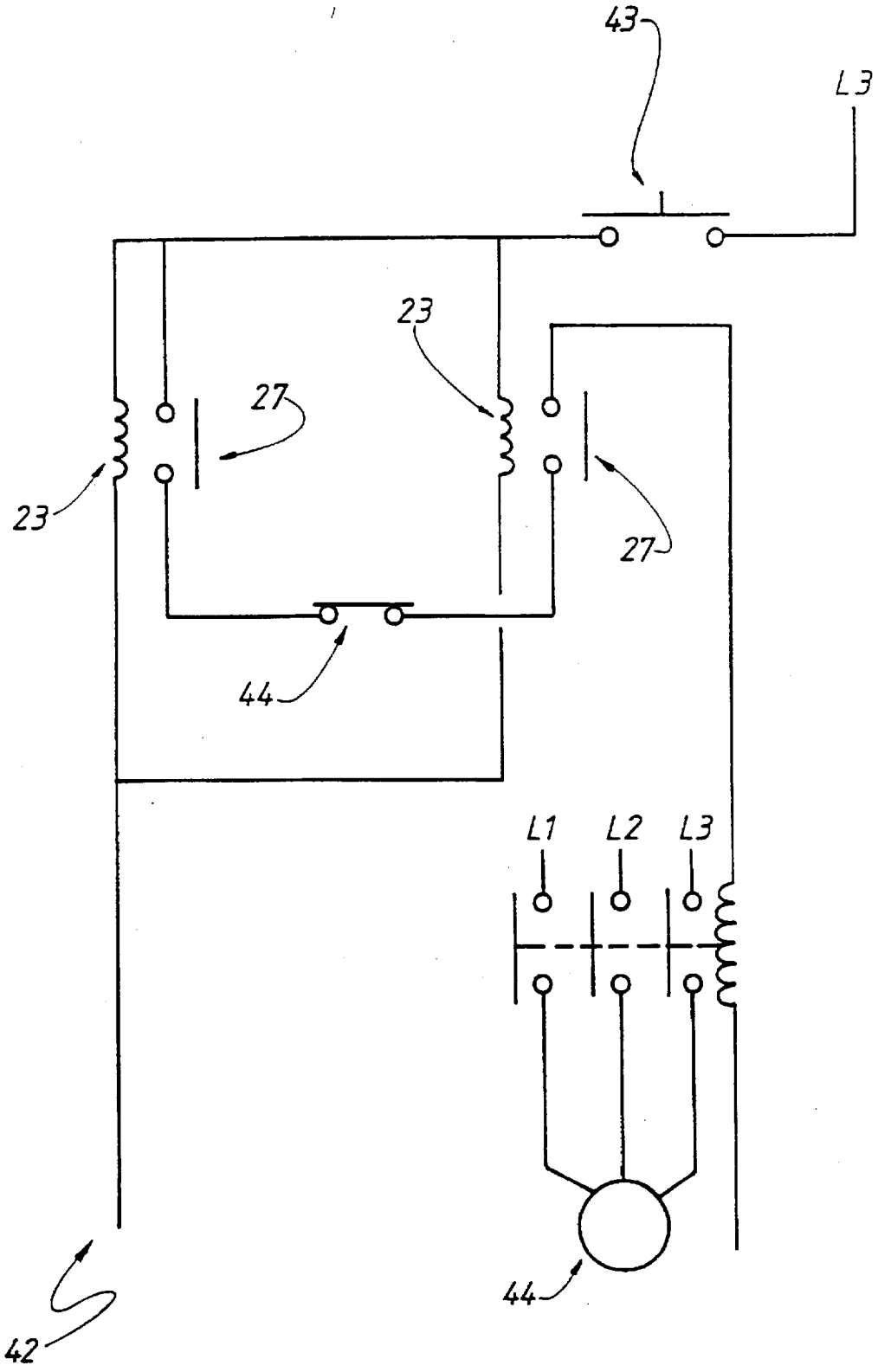
FIG. 7 is a schematic circuit diagram illustrating application of the present invention to a dual locking assembly installation of the type illustrated in FIGS. 5 and 6.

Referring now to FIG. 7, there is illustrated a schematic circuit diagram suitable for driving the assembly 40 of FIGS. 5 and 6. Where appropriate, like numerals have been used to illustrate like features.

Circuit 42 includes a main switch 43 which is used to deliver power to the solenoids 23 of the respective locking assemblies 13 which in turn switch on the respective limit switches 27 when the retractable feet 16 are drawn back into the body of the locking assemblies.

This in turn makes the circuit to the motor 44 and as both feet 16 of the respective locking assemblies have been retracted and a top limit switch 45 is closed (until the curtain 11 is fully raised), the motor 44 thereby operates to raise the curtain 11. A "down" button operatively linked to the "up" button and associated circuit (not shown) is used to reverse the motor and return the curtain 11 to the fully down position which in turn mechanically releases the feet 16 as previously described to thereby lock the door closed. A lower limit switch can be employed to switch off power to the motor once curtain 11 is lowered.

Whilst the above has been given by way of illustrative example of the present invention, many variations and modifications thereto will be apparent to those skilled in the art without departing from the broad ambit and scope of the invention as set forth in the appended claims.

I claim:

1. A roller shutter comprising:

a shutter having a leading edge and being moveable between a raised open position and a lowered closed position;

a locking assembly having an electrically driven retractable blocking member that blocks the leading edge of said shutter and prevents movement of said shutter away from the lowered closed position, said locking assembly having a retraction element that manually retracts the blocking member from an extended position engageable with the leading edge to a retracted position not engageable with the leading edge;

a control circuit that controls said locking assembly, said control circuit including circuitry and an actuator for initiating a shutter raising action, the circuitry including a solenoid operable to hold the blocking member in the extended position and to retract the blocking member to the retracted position in response to the actuator initiating the shutter raising action; and a releasable shutter actuated catch that releasably holds the blocking member in the retracted position, said catch releasing the blocking member when said shutter moves to the lowered closed position.

2. A roller shutter according to claim 1, wherein the blocking member includes a retractable foot having a pivot about which an eccentrically mounted weight pivots such that the foot is biased to hang in an extended position, thereby blocking movement of said shutter.

3. A roller shutter according to claim 1, wherein said shutter is drivable by a motor and said control circuitry employs a motor override switch that prevents the motor from operating unless the blocking member is in the retracted position.

4. A roller shutter according to claim 1, wherein said locking assembly is housed in a housing secured in a fixed location adjacent the lowered closed position of the shutter.

5. A roller shutter according to claim 1, further comprising opposed channels that guide movement of said shutter, and wherein said locking assembly is secured to a lowermost position of at least one of said opposed channels.

6. A roller shutter according to claim 1, further comprising a housing enclosing said locking assembly, said housing being secured in a fixed location adjacent the lowered closed position of the leading edge of said shutter, said housing being secured directly to one of flooring, an adjacent wall, and a bracket secured to one of the flooring and the wall.

7. A roller shutter according to claim 1, further comprising an additional locking assembly, said locking assembly and said additional locking assembly being disposed on opposing edges of said shutter.

* * * * *